US006572207B2

(12) United States Patent
Hase et al.

(10) Patent No.: US 6,572,207 B2
(45) Date of Patent: Jun. 3, 2003

(54) CABINET COOLER

(75) Inventors: Gary M. Hase, Monee, IL (US); David A. Arnold, Schererville, IN (US); Paul W. Wiechen, Beecher, IL (US)

(73) Assignee: H&R Industries, Inc., Beecher, IL (US)

( * ) Notice: Subject to any disclaimer, the term of this patent is extended or adjusted under 35 U.S.C. 154(b) by 0 days.

(21) Appl. No.: 10/225,611

(22) Filed: Aug. 22, 2002

(65) Prior Publication Data

US 2003/0001468 A1 Jan. 2, 2003

Related U.S. Application Data

(62) Division of application No. 09/777,465, filed on Feb. 6, 2001.

(60) Provisional application No. 60/180,605, filed on Feb. 7, 2000.

(51) Int. Cl.[7] ..... A47B 77/08

(52) U.S. Cl. ..... 312/236; 165/919

(58) Field of Search ..... 312/236, 249.9, 312/249.1, 249.8, 350, 351; 165/48.1, 61, 918, 919

(56) References Cited

U.S. PATENT DOCUMENTS

| | | | | |
|---|---|---|---|---|
| 1,882,237 A | | 10/1932 | Weston | |
| 2,275,772 A | * | 3/1942 | Koch | 312/236 X |
| 2,506,448 A | | 5/1950 | Gregor | |
| 2,677,245 A | | 5/1954 | Edmondson | |
| 3,058,320 A | | 10/1962 | Foster et al. | |
| 3,129,041 A | | 4/1964 | Traycoff et al. | 312/236 |
| 3,261,650 A | | 7/1966 | Stromqvist | |
| 3,719,408 A | | 3/1973 | Fullington et al. | |
| 3,836,220 A | | 9/1974 | Ishammar | 312/236 |
| 3,866,435 A | | 2/1975 | Frank et al. | |
| 3,976,122 A | | 8/1976 | Neidhardt | |
| 4,103,736 A | | 8/1978 | Colato et al. | |
| 4,180,125 A | | 12/1979 | Schulz et al. | 312/236 X |
| 4,285,391 A | | 8/1981 | Bourner | |
| 4,323,110 A | | 4/1982 | Rubbright et al. | |
| 4,346,756 A | | 8/1982 | Dodd et al. | |
| 4,397,159 A | | 8/1983 | Dodd | |
| 5,397,010 A | | 3/1995 | Gibot | |
| 5,655,595 A | | 8/1997 | Westbrooks, Jr. | |

FOREIGN PATENT DOCUMENTS

| | | |
|---|---|---|
| EP | 0080313 | 6/1983 |
| GB | 2300702 | 11/1996 |
| JP | 5317127 | 12/1993 |

* cited by examiner

*Primary Examiner*—James O. Hansen
(74) *Attorney, Agent, or Firm*—Trexler, Bushnell, Giangiorgi, Blackstone & Marr, Ltd.

(57) ABSTRACT

The cabinet cooler has an open housing defined by a lower wall, a rear wall, opposite side walls, and a top wall. The lower wall has a plurality of wheels positioned on a bottom thereof so that the cabinet cooler can be easily moved. The lower wall also has a pair of slots therethrough having flexible seals therein such that a wheeled rack can be rolled into the opening of the housing. A door attached to one of the side walls can close the housing once the rack is wheeled into the housing. A plurality of fans pull air over dry ice cell(s) to cool the air within the housing and force the cooled air over the rack, which can hold a plurality of trays capable of holding food.

16 Claims, 8 Drawing Sheets

20
34
61
66
72
89
88
80
68
70
106
62
46
104
38
64
30
100a
100b
64
46
28
24
102
62
56
56
58
36
98
26
98
98
36
36

CABINET COOLER

CROSS REFERENCE

This is a divisional application of application Ser. No. 09/777,465, filed on Feb. 6, 2001 and entitled "Cabinet Cooler".

This patent application claims the benefit of domestic priority of United States Provisional Application Serial No. 60/180,605, filed Feb. 7, 2000, and entitled "Cabinet Cooler".

BACKGROUND OF THE INVENTION

In many different industries, most notably, the airline catering industry, food products must be transferred from one area to another after preparation and before service. Food products after preparation are generally hot, for example, 170° F. The food products are then placed on trays which, in turn, are placed on a movable rack. The rack is then usually placed within a cabinet cooler, to reduce the temperature of.the food products to a desired temperature of, for example, 40° F. Thereafter, the rack can be removed from the cabinet cooler and moved into a conventional walk-in cooler for the final reduction in temperature of the food products to a temperature of, for example, 38° F. When the user is ready to process the food products, the rack is removed from the walk-in cooler for final processing of the food products by the user.

Problems have arisen, though, with the movement of the food products after preparation, to the walk-in cooler, and then to their final destination, i.e., airline carts. The food products will not maintain the desired temperature as they must be moved from place to place outside of a controlled environment of the desired temperature. Generally, the cabinet cooler is stationary and is connected to an intricate plumbing system, or requires the use of liquid nitrogen or liquid $CO_2$. These cabinet coolers also generally require the user to push the rack onto a ramp in order to insert the rack within the cabinet cooler. Such a setup can cause safety problems.

Therefore, there is a need for an effective cabinet cooler that is portable such that it can move by itself, or in conjunction with a rack holding food products therein. There is also a need for an effective cabinet cooler that is capable of sealing cooled air therein when the rack is positioned therein. The present invention provides such a cabinet cooler. Other advantages of the present invention will become apparent upon reading the attached specification in combination with a study of the drawings.

OBJECTS AND SUMMARY OF THE INVENTION

A primary object of the invention is to provide a novel portable container system which is used for cooling of in-process food that is particularly applicable to the airline catering industry.

Another object of the invention is to provide a portable cabinet cooler that does not require a ramp for the rack to be rolled therein.

Yet another object of the.invention is to provide a cabinet cooler which uses dry ice, as opposed to liquid nitrogen or liquid $CO_2$.

Still another object of the invention is to provide a cabinet cooler that requires no fixed plumbing, but only a 100v plug in.

Another object of the invention is to provide a cabinet cooler having elongated slots in a lower wall thereof to allow the legs of a rack to wheeled therein and to act as guides for the rack legs.

Yet another object of the present invention is to provide flexible seals along the length of the elongated slots which conform to the legs of the rack when the rack is positioned therein for sealing the bottom of the cabinet cooler.

Still another object of the present invention is to provide a cabinet cooler that is capable of rapidly cooling the inside thereof.

Another object of the present invention is to provide a cabinet cooler which allows a rack to roll directly into the cabinet cooler without any additional devices or modifications to the rack.

Yet another object of the present invention is to provide a cabinet cooler where the fans and driving means can be easily serviced and cleaned.

Another object of the present invention is to provide a cabinet cooler that can operate as either a cooler/freezer or, if desired, as an isothermal container to maintain the temperature within the cabinet cooler.

Briefly, and in accordance with the foregoing, the present invention provides a novel cabinet cooler. The cabinet cooler has an open housing defined by a lower wall, a rear wall, opposite side walls, and a top wall. The lower wall.has a plurality of wheels positioned on a bottom thereof so that the cabinet cooler can be easily moved. The lower wall also has a pair of slots therethrough having flexible seals therein such that a wheeled rack can be rolled into the opening of the housing. A door attached to one of the side walls can then close the housing once the rack is wheeled into the housing. A plurality of fans pull air over dry ice cell(s) to cool the air within the housing and force the cooled air over the rack, which can hold a plurality of trays capable of holding food.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
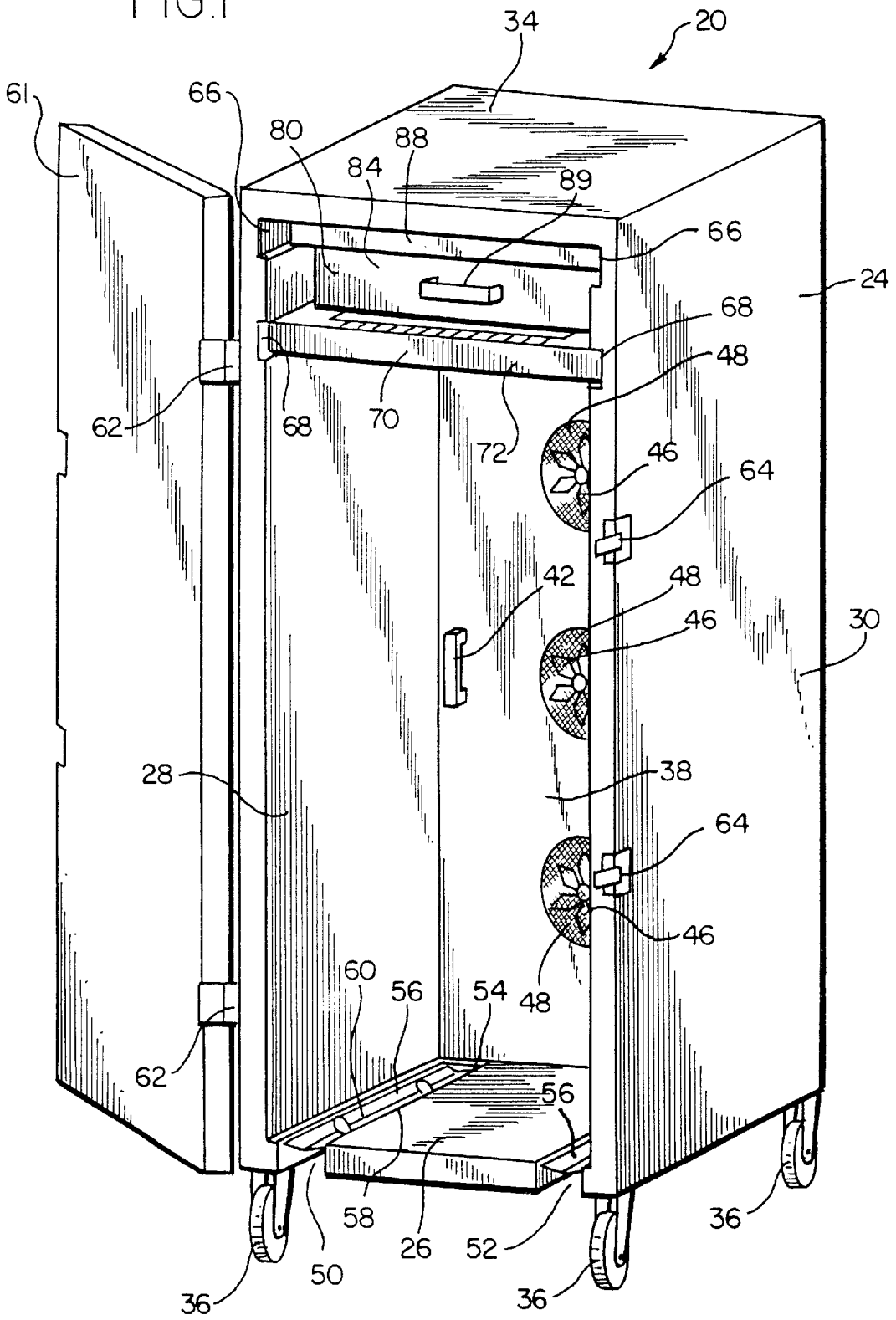
FIG. 1 is a perspective view of a novel cabinet cooler, having three fans, which incorporates the features of a first embodiment of the present invention.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Figure 9:
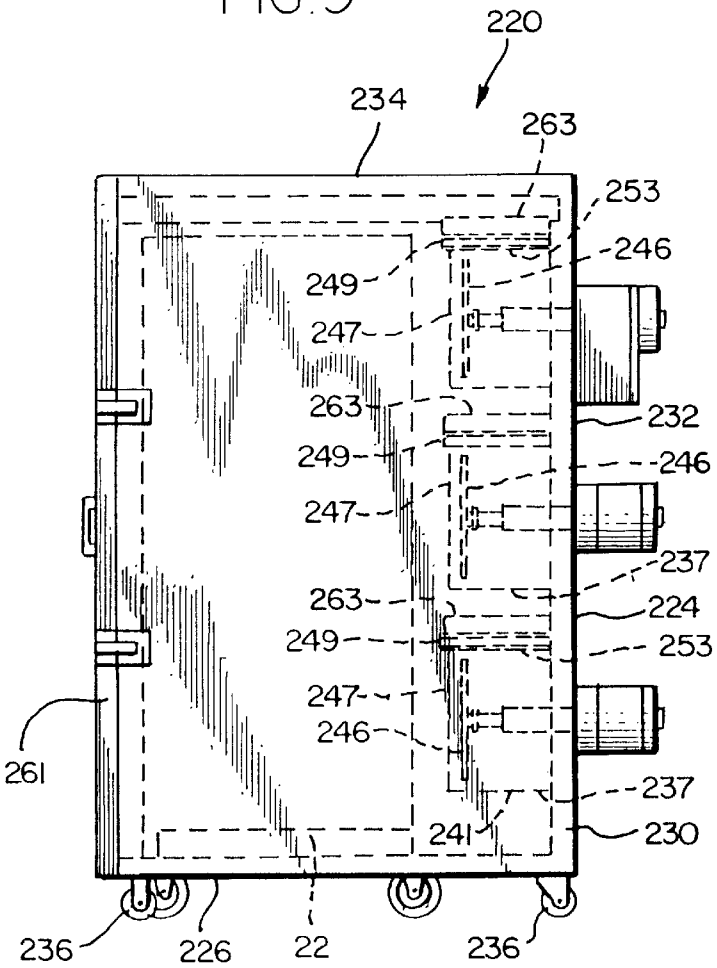
FIG. 9 is a side elevational view of the cabinet cooler of the second embodiment of the present invention, having components of the cabinet cooler shown in phantom lines, with the rack placed therein and shown in phantom lines.
Figure 4:
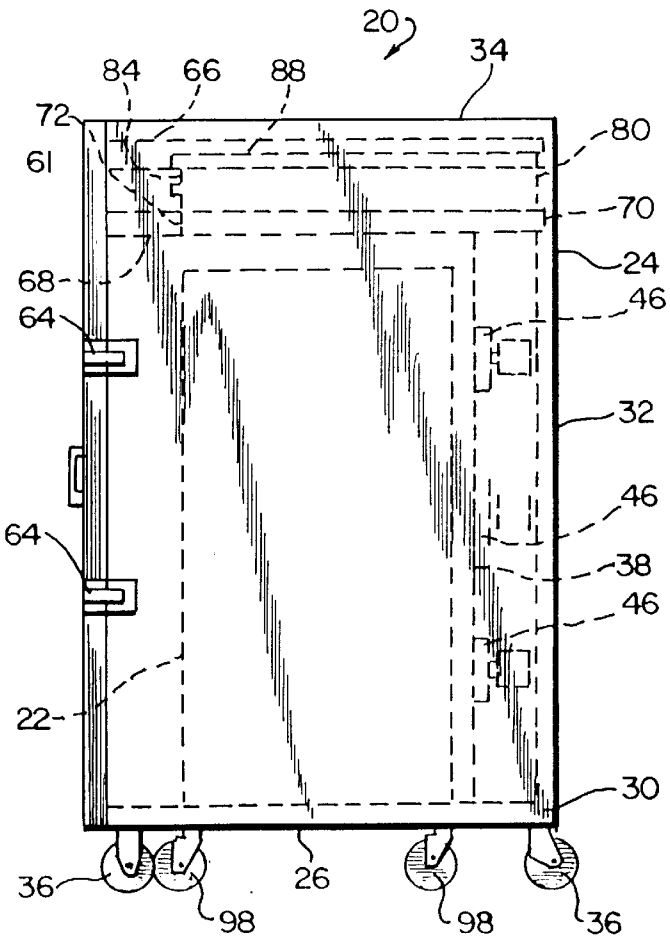
FIG. 4 is a side elevational view of the cabinet cooler, having three fans, of the first embodiment of the present invention, having components of the cabinet cooler shown in phantom lines, with the rack placed therein and shown in phantom lines.
Figure 5:
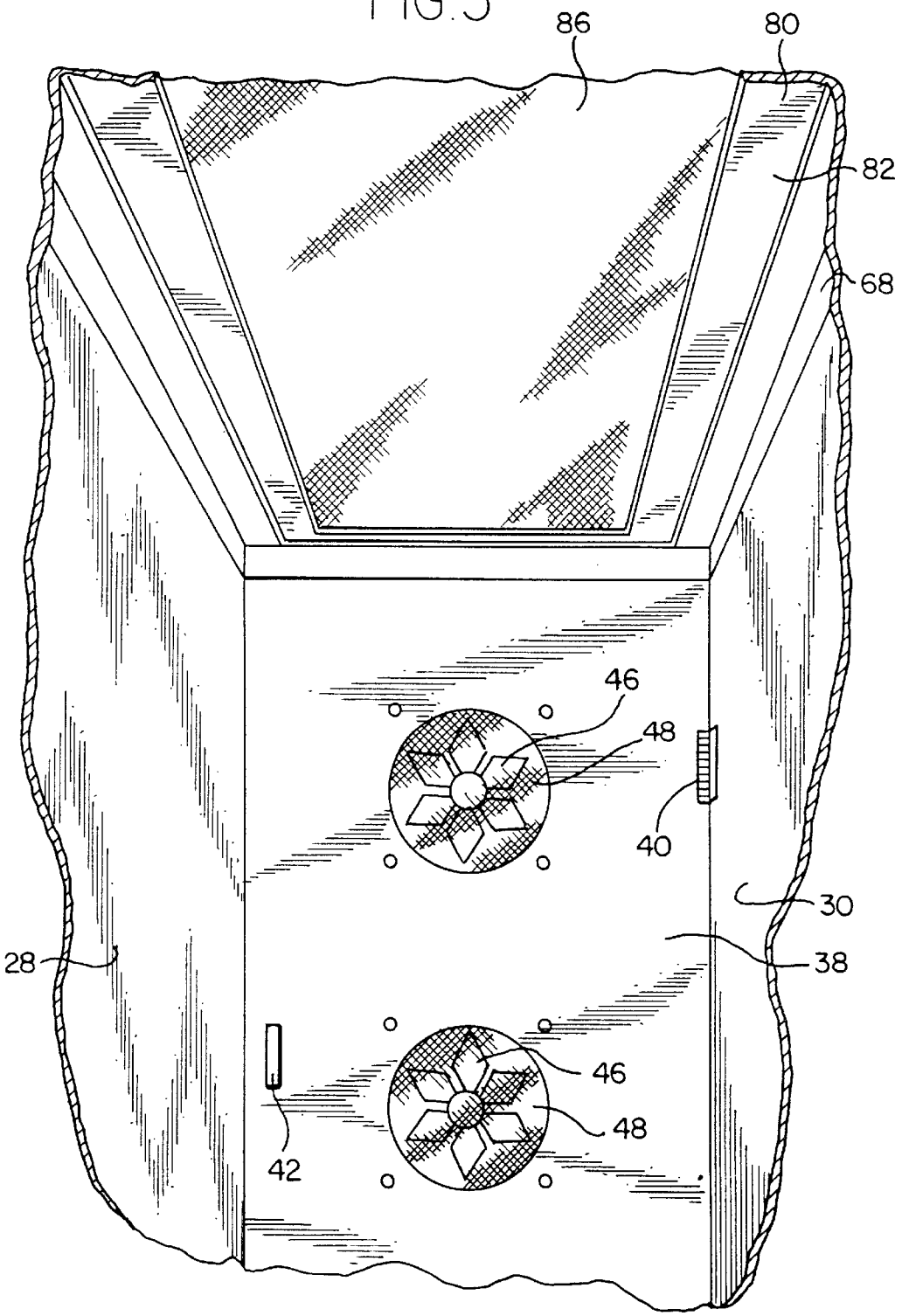
FIG. 5 is a partial fragmentary front perspective view of the cabinet cooler, having three fans, of the first embodiment of the present invention.

The present invention provides a novel cabinet cooler 20, 220 into which a rack 22 can be easily rolled into and out of The rack 22.can be wheeled directly into and out of the cabinet cooler 20, 220 without the use of ramps. The cabinet cooler 20 is particularly suitable for use in the airline industry, but can be used in other industries as well. A first embodiment of the present invention is shown in FIGS. 1 and 3–6. A second embodiment of the present invention is shown in FIGS. 7–9. Like elements are denoted with like reference numerals with the first embodiment being in the tens and one hundreds, and the second, embodiment being in the two hundreds.

Attention is now invited to the first embodiment of the cabinet cooler 20 shown in FIGS. 1 and 3–6. The cabinet cooler 20 includes a housing 24 which is formed from a lower wall 26, opposite side walls 28, 30 extending upwardly from side edges of the lower wall 26, a rear wall 32 extending upwardly from a rear edge of the lower wall 26, and a top wall 34 which is connected to the upper ends of the side walls 28, 30 and the rear wall 32. The walls 26, 28, 30, 32, 34 are made of a suitable material, such as fiberglass reinforced plastic composite material, or polyethylene. Wheels 36 are provided at each corner of the bottom wall 26 to allow a user to roll the cabinet cooler 20 around.

A partition 38 is mounted within the housing 24 and extends vertically upwardly from the lower wall 26 a predetermined distance. The partition 38 spans the width of the rear wall 32 such that the partition 38 extends between the side walls 28, 30. The partition 38 is spaced from the rear wall 32 a predetermined distance. The partition 38 does not extend to the top wall 34 so that a space is provided between the partition 38 and the rear wall 32 at the top of the partition 38. The partition 38 is made of a suitable material, such as metal or plastic. Hinges 40 are provided on one side edge of the partition 38 and are connected to one of the side walls, for example side wall 28. A handle 42 is mounted on the opposite side of the partition 38. The free end of the partition 38 has latches (not shown) thereon which secure with respective catches (not shown) provided on the housing 24.

At least one fan 46, shown as either two or three in number in the drawings, is mounted between the partition 38 and the rear wall 32. Each fan 46 communicates with an aperture 48 through the partition 38 such that air can circulate within the housing 24. The fans 46 are driven by suitable means, such as a 110V AC current battery. The partition 38 can be swung open by a user grasping the handle 42 and swinging the partition.38 around the hinges to expose the fans 46 and the driving means so that the fans 46 and the driving means can be serviced and cleaned.

The bottom wall 26 includes two elongated slots 50, 52 which extend from the front of the bottom wall 26 to a position which is proximate to, but spaced from, the partition 38. Accordingly, the bottom of the space between the partition 38 and the rear wall 32 is closed by the bottom wall 26 of the housing 24.

An elongated frame 54 which matches the shape of each slot 50, 52 is provided in each slot 50, 52. The frame 54 can be snapped into or seated in each slot 50, 52. A flexible seal 56, 58 is mounted on the frame. The seal 56, 58 is formed from two strips 56, 58 of vinyl which overlap each other such that an elongated slit 60 is formed along the length of the seal 56, 58. Each frame 54 and its associated seal 56, 58 is removable from the bottom wall 26 so that each frame 54 and seal 56, 58 can be cleaned.

A door 61 can be hingedly connected to one of the side walls 28 and can be swung around the hinges 62 to close the front of the housing 24. The other side wall 30 can have latches 64 which connect with catches (not shown) on the free end of the door 61 when the door 61 is closed to secure the door 61 in a closed position. Alternatively, the door 61 and its associated hardware, can be eliminated and vinyl strips (not shown) can be attached to the top wall 34 and hang downwardly therefrom to cover the open front of the housing 24.

An upper elongated slot 66 is provided along each side wall 28, 30 proximate to the top wall 34 of the housing 24. Each upper slot 66 extends from the front of the respective side wall 28, 30 to the front of the rear wall 32. The upper slots 66 are vertically aligned with each other. A lower elongated slot 68 is provided along each side wall 28, 30 and is spaced from the respective upper slots 66 and is proximate to the top of the partition 38. Each lower slot 68 extends from the front of the respective side wall 28, 30 to the front of the rear wall 32. The lower slots 68 are vertically aligned with each other.

A thermopanel 70, formed of a suitable material, such as fiberglass or polyethylene with urethane insulation, is slidably mounted within the lower slots 66. The thermopanel 70 includes a front wall 72, opposite side walls (not shown) which extend from opposite side edges of the front wall 72, and a bottom wall (not shown) which extends from the bottom edges. The thermopanel 70 has a width which is slightly less than the distance between the outermost edges of the lower slots 68. The thermopanel 70 has a length which is less than the length of the side walls 28, 30. As such, the thermopanel 70 can be slid along the length of the slots 68 such that the thermopanel 70 can be moved to abut against the rear wall 32 of the housing 24 or can be moved away from the rear wall 32 of the housing 24. In either position, the thermopanel 70 does not abut against the door 61 or the hanging vinyl-strips. When the thermopanel 70 is moved to abut against the rear wall 32 of the housing 24, the thermopanel 70 closes the top end of the space between the partition 38 and the rear wall 32. When the thermopanel 70 is moved away from the rear wall 32 of the housing 24, the space between the partition 38 and the rear wall 32 is open. The thermopanel 70 separates the interior of the housing 24 into an upper chamber and a lower chamber.

A dry ice storage 80 is removably mounted within the upper chamber of the housing 24. The dry ice storage 80 is formed from a drawer having a bottom wall 82, opposite side walls (not shown) which extend upwardly from side edges of the bottom wall 82, a front wall 84 which extends upwardly from a front edge of the bottom wall 82, and a rear wall (not shown) which extends upwardly from a rear edge of the bottom wall 82. As such, the upper end of the dry ice storage 80 is open. The bottom wall 82 of the dry ice storage 80 has an opening therein. A mesh screen 86 is mounted therein defining a plurality of perforations through the bottom wall 82. The walls of the dry ice storage 80 are formed from a suitable material, such as fiberglass or reinforced plastic. The mesh screen 86 is formed from a suitable material, such as expanded metal. The front wall 84 is insulated with suitable insulating material. The dry ice storage 80 has a dry ice cell (not shown), which can be a dry ice slab or dry ice pellets, provided therein. The upper end of the front wall 84 and the upper end of the side walls has a ledge 88 which protrudes outwardly therefrom. The dry ice storage 80 is mounted within the upper chamber of the housing 24 by sliding the side edges of the ledge 88 along the respective upper slots 66. A handle 89 may be provided on the front wall 84 of the dry ice storage 80 for convenience in inserting the dry ice storage 80 into the housing 24 and removing the dry ice storage 80 from the housing 24.

Figure 2:
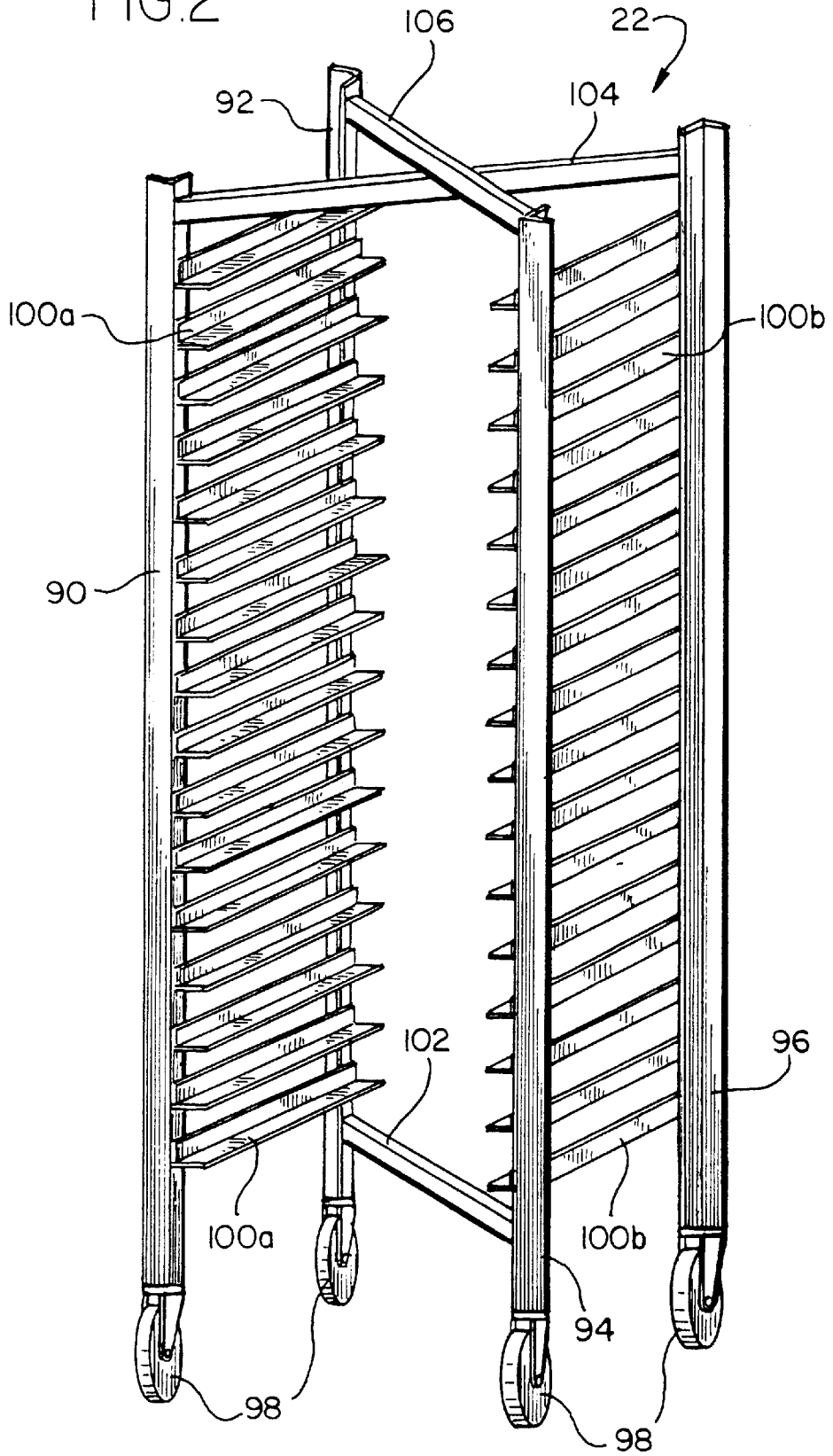
FIG. 2 is a perspective view of a rack of the present invention.
Figure 3:
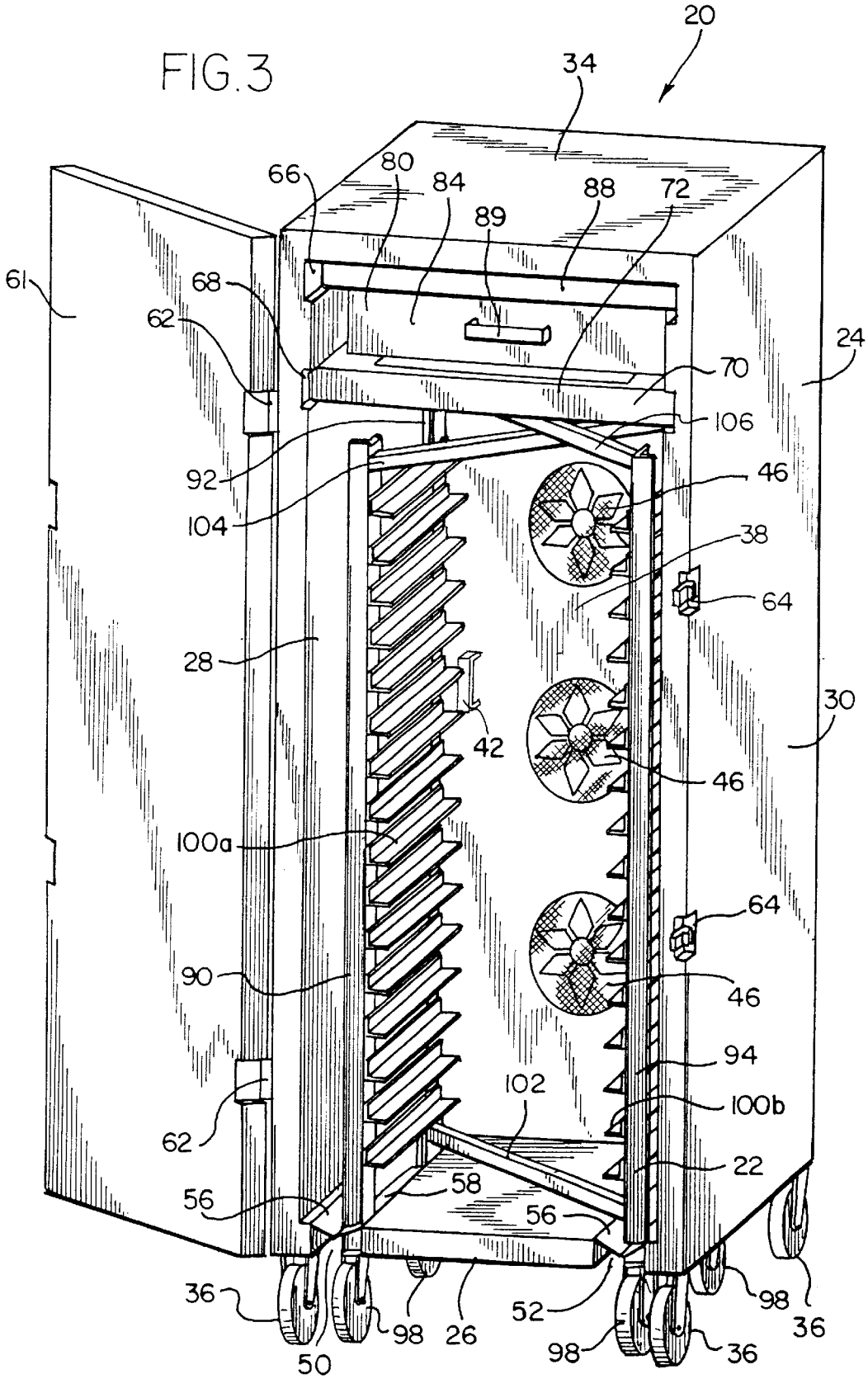
FIG. 3 is a perspective view of the cabinet cooler, having three fans, of the first embodiment of the present invention with the rack placed therein.

The rack 22 that is used with the cabinet cooler 20 of the present invention is conventional and is illustrated in FIG. 2. The rack 22 includes four vertical legs 90, 92, 94, 96, each of which has a wheel 98 mounted on a lower end thereof. A plurality of horizontal support members 10*a* are provided between two of the legs 90, 92, and a plurality of horizontal support members 100*b* are provided between the other two legs 94, 96. The respective horizontal support member 100*a*, 100*b* are aligned with each other and face each other. A lower diagonal bar 102 is provided between two of the legs 92, 94 at a position spaced from the bottom ends of the legs 92, 94. A first upper diagonal bar 104 is provided between two of the legs 90, 96 at a position spaced from the upper ends of the legs 90, 96. A second upper diagonal bar 106 is provided between the other two legs 92, 94 at the upper ends of the legs 92, 94 such that the first and second upper bars 104, 106 cross over each other and form an X. Trays (not shown) can be removably mounted on the rack 22 by sliding the trays along the support members. 100*a*, 100*b*.

To place the rack 22 within the cabinet cooler 20, the user opens the door 61 or parts the vinyls strips. Thereafter, the user rolls the rack 22 into the cabinet cooler 20 such that the legs 90, 92 of the rack 22 enter into slot 50 within the bottom wall 26 and the other legs 94, 96 of the rack 22 enter into slot 52 within the bottom wall 26. The seals 56, 58 within each slot 50, 52 conform to the shape of the legs 90, 92, 94, 96 to substantially prevent the leakage of air from within the cabinet cooler 20 to the outside. If desired, cutouts can be provided in the seals 56, 58 to mold around the legs 90, 92, 94, 96. The door 61 is then closed or the vinyl strips are allowed to fall back into place. There is no need to modify the rack 22 or to use ramps to place the rack 22 within the cabinet cooler 20.

If the thermopanel 70 is in the open position, that is, the thermopanel 70 is pulled away from the rear wall 32 of the housing 24, air is circulated through the housing 24 by using the fans 46. The fans 46 are driven to blow air toward the door 61 or the vinyl strips. The air flows over the trays (which have food products or the like thereon), from the back of the trays to the front of the trays and up the front of the housing 24 between the thermopanel 70 and the door 61 or the vinyl strips. The air then flows between the thermopanel 70 and the dry ice storage 80. As the air flows between the thermopanel 70 and the dry ice storage 80, the air is cooled by the dry ice contained within the dry ice storage 80. The air then flows between the partition 38 and the rear wall 32 for recirculation through the housing 24. The fans 46 suck the air from between the thermopanel 70 and the dry ice storage 80.

If the thermopanel 70 is in the closed position, that is, the thermopanel 70 abuts against the rear wall 32 of the housing 24 such that the space between the partition 38 and the rear wall 32 is closed, the air is not circulated through the housing 24. Instead, the cabinet cooler 20 acts as an isothermal container to maintain the temperature of the food products or the like on the trays. Coldness from the dry ice passes through the thermopanel 70 to the food products or the like in the lower chamber.

To remove the rack 22 from the cabinet cooler 20, the user opens the door 61 or parts the vinyls strips. Thereafter, the user rolls the rack 22 out of the cabinet cooler 20. The door 61 is then closed or the vinyl strips are allowed to fall back into place. There is no need to modify the rack 22 or to use ramps to remove the rack 22 from the cabinet cooler 20.

Figure 6:
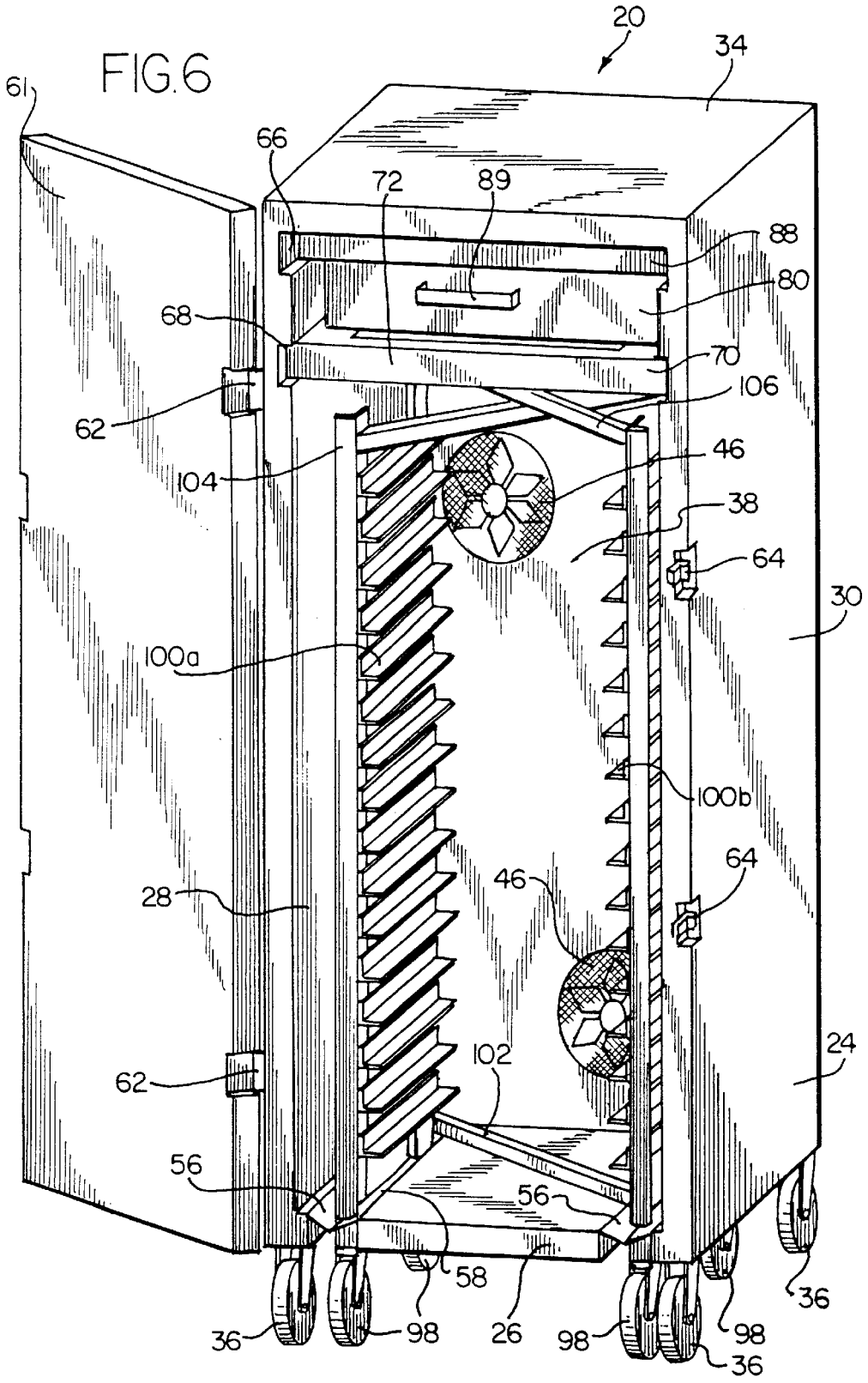
FIG. 6 is a perspective view of the cabinet cooler; having two fans, which incorporates features of the first embodiment of the present invention with the rack placed therein and shown in perspective.
Figure 7:
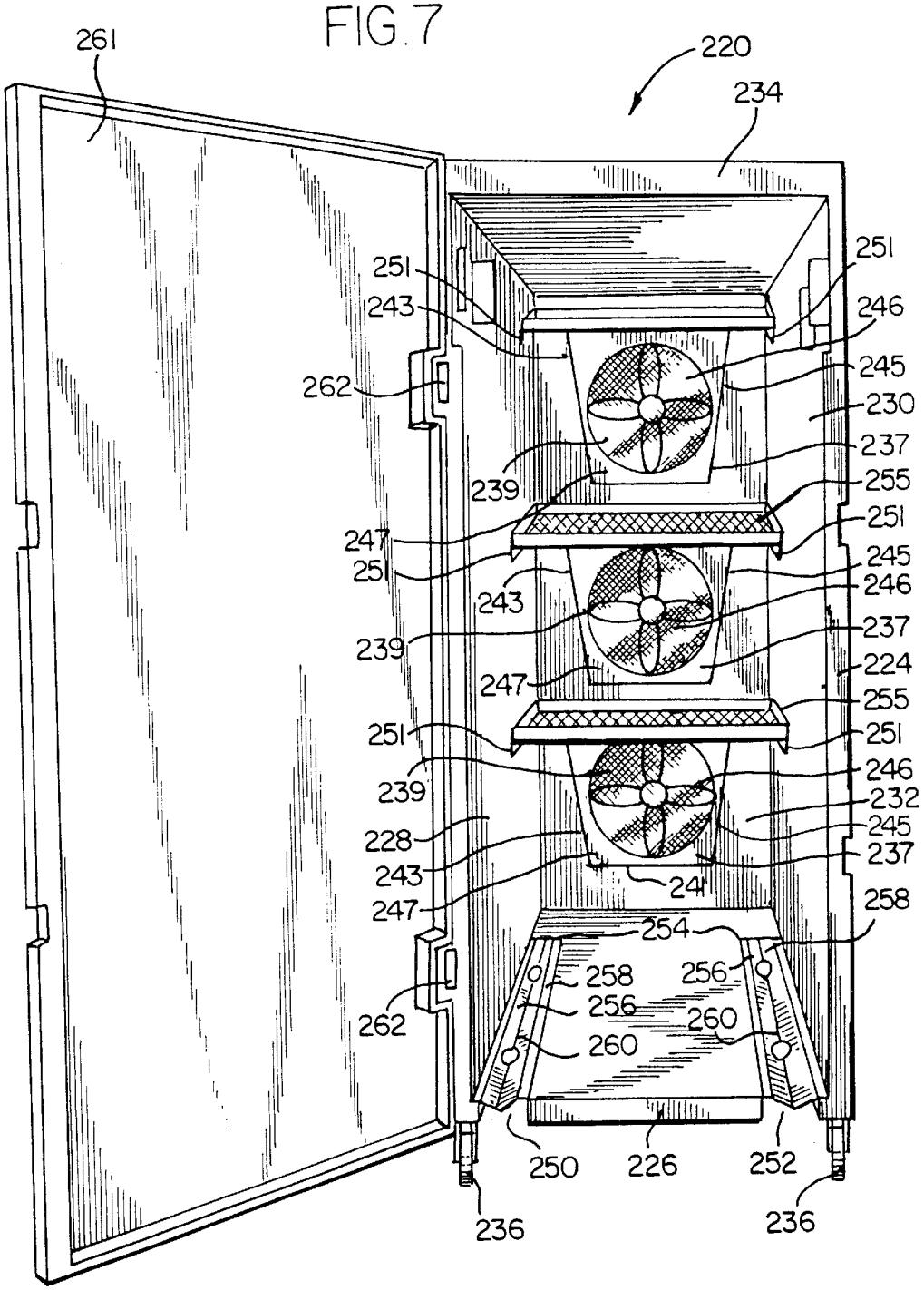
FIG. 7 is a front perspective view of the cabinet cooler of the second embodiment of the present invention.
Figure 8:
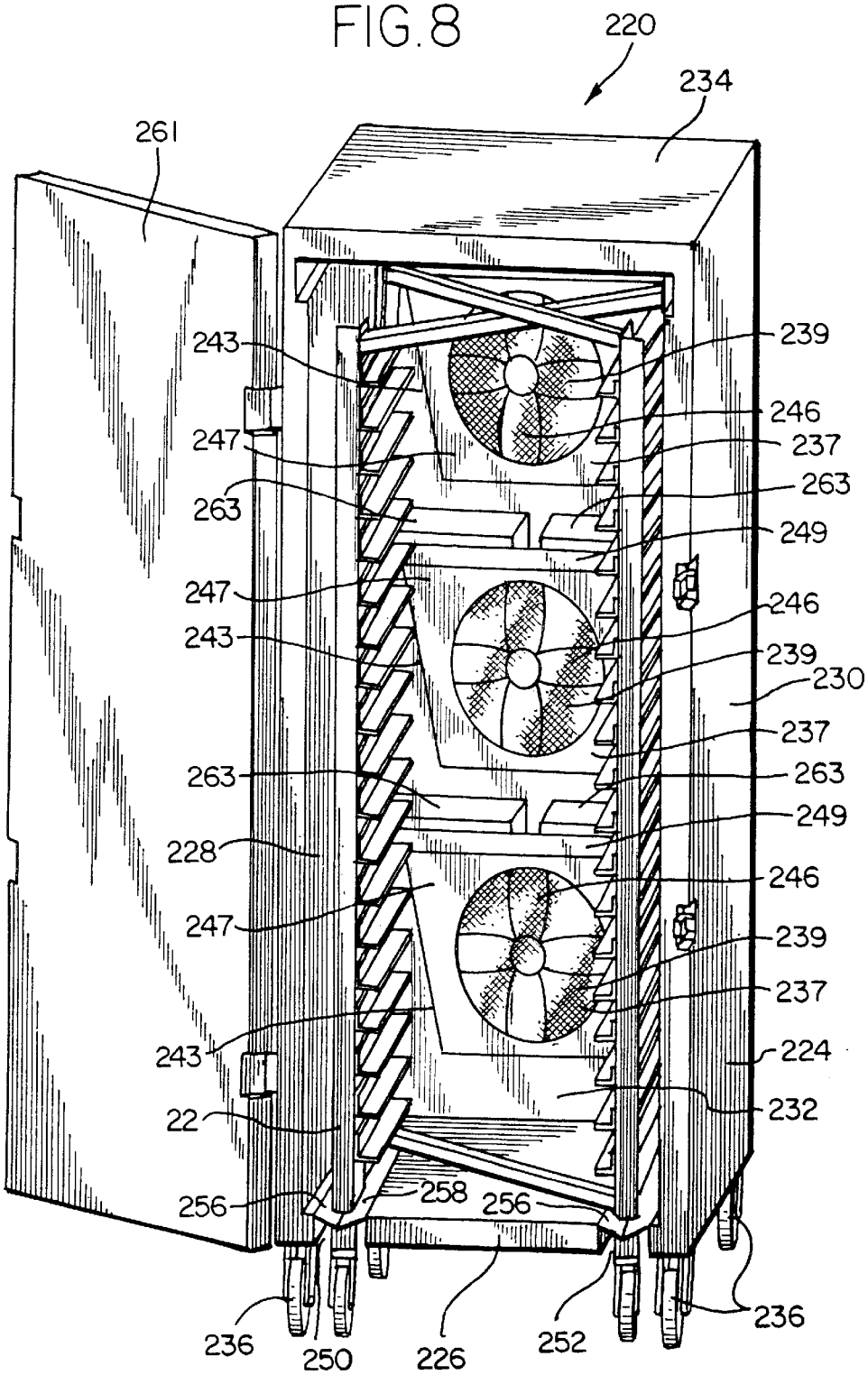
FIG. 8 is a front perspective view of the cabinet cooler of the second embodiment of the present invention with the rack placed therein and shown in perspective.

Attention is now invited to the second embodiment of the cabinet cooler 220 shown in FIGS. 6–8. The cabinet cooler 220 includes a housing 224 which is formed from a lower wall 226, opposite side walls 228, 230 extending upwardly from side edges of the lower wall 226, a rear wall 232 extending upwardly from a rear edge of the lower wall 226, and a top wall 234 which is connected to the upper ends of the side walls 228, 230 and the rear wall 232. The walls 226, 228, 230, 232, 234 are made of a suitable material, such as fiberglass reinforced plastic composite material, or polyethylene. Wheels 236 are provided at each corner of the bottom wall to allow a user to roll the cabinet cooler 220 around.

At least one fan 246, shown as three in number in the drawings, is mounted between the rear wall 232 and a respective fan housing 237 which is mounted to the rear wall 232. Each fan 246 communicates with an aperture 239 through the fan housing 237 such that air can circulate within the housing 224. The fans 246 are driven by suitable means, such as a 110V AC current battery.

Each fan housing 237 has a bottom wall 241, opposite side walls 243, 245 which extend upwardly and outwardly from side edges of the bottom wall 241 and a front wall 247 which extends upwardly from a front edge of the bottom wall 241 and is connected to front edges of the side walls 243, 245. As such, the upper end of the fan housing 237 is open. The bottom wall 241 and the side walls 243, 245 extend from the rear wall 232 of the housing 224 into the cavity within the housing 224 formed by the walls 226, 228, 230, 232, 234. The front wall 247 is parallel to the rear wall 232 and is generally V-shaped as the opposite side walls 243, 245 extend upwardly and outwardly from side edges of the bottom wall 241. The aperture 239 of the fan housing 237 is provided through the front wall 247 of the fan housing 237. The fan housing 237 is made of a suitable material, such as fiberglass reinforced plastic composite material, or polyethylene.

A tray 249 can be positioned on top of each fan housing 237. The trays 249 span the width of the rear wall 232 such that the trays 249 extend between sidewalls 228, 230. The trays 249 also extend from the rear wall 232 to the front wall 247 of the fan housing 237. Supports 251 can be mounted to each of the side walls 228, 230 to support the ends of the tray 249 while the side walls 243, 245 and front wall 247 of the fan housing 237 support the middle of the trays 249.

A bottom wall 253 of the tray 249 has an opening therein that is in communication with the open upper end of the fan housing 237. A mesh screen 255 is mounted within the opening of the bottom wall 253 and defines a plurality of perforations through the bottom wall 253. The mesh screen 255 is formed from a suitable material, such as expanded metal. The bottom wall 253 of the tray 249 is used to support at least one dry ice cell 263, which can be a dry ice slab or dry ice pellets. The tray 249 can be removed from the housing 224 such that a user does not have to directly handle the dry ice cell 263. The tray 249 can further include front, side and rear walls if desired.

The bottom wall 226 of the cabinet cooler 220 includes two elongated slots 250, 252 which extend from the front of the bottom wall 226 to a position which is spaced from the rear wall 232 of the housing 224. An elongated frame 254 which matches the shape of each slot 250, 252 is provided in each slot 250, 252. The frame 254 can be snapped into or seated in each slot 250, 252. A flexible seal 256, 258 is mounted on the frame 254. The seal 256, 258 is formed from two strips of vinyl which overlap each other such that an elongated slit 260 is formed along the length of the seal 256, 258. Each frame 254 and its associated seal 256, 258 is removable from the bottom wall 226 so that each frame 254 and seal 256, 258 can be cleaned.

A door 261 can be hingedly connected to one of the side walls 228 and can be swung around the hinges 262 to close the front of the housing 224. The other side wall 230 can have latches 264 which connect with catches (not shown) on the free end of the door 261 when the door 261 is closed to secure the door 261 in a closed position. Alternatively, the door 261 and its associated hardware, can be eliminated and vinyl strips (not shown) can be attached to the top wall 234 and hang downwardly therefrom to cover the open front of the housing 224.

The rack 22 that is used with the cabinet cooler 220 of the second embodiment of the present invention is conventional and is exactly the same as that used with the cabinet cooler 20 of the first embodiment of the present invention. Therefore, the description of the rack 22 is not repeated.

Prior to the insertion of the rack 22 into the cabinet cooler 220, slabs of dry ice 263 are placed on the trays 249. The trays 249 are slid into the housing 224 and are seated on the supports 251 and on top of the fan housing 237. To place the rack 22 within the cabinet cooler 220, the user opens the door 261 or parts the vinyl strips. Thereafter, the user rolls the rack 22 into the cabinet cooler 220 such that the legs 90, 92 of the rack 22 enter into slot 250 within the bottom wall 226 and the other legs 94, 96 of the rack 22 enter into slot 252 within the bottom wall 226. The seals 256, 258 within each slot 250, 252 conform to the shape of the legs 90, 92, 94, 96 to substantially prevent the leakage of air from within the cabinet cooler 220 to the outside. If desired, cutouts can be provided in the vinyl strips to mold around the legs 90, 92, 94, 96. The door 261 is then closed or the vinyl strips are allowed to fall back into place. The rack 22 does not contact the fan housings 237 or trays 249 because the slots 250, 252 of the lower wall 226 do not extend far enough into the housing 224. There is no need to modify the rack 22 or to use ramps to place the rack 22 within the cabinet cooler 220.

After the insertion of the rack 22 into the cabinet cooler 220, the cool air that is emitted from the respective slabs of dry ice 263 is sucked through the perforations defined by the mesh screen 255 of the tray 249 and into the fan housing 237 by the fans 246. This cools the air. The V-shaped side walls 243, 245 of the fan housing 237 help draw cold air down to the fans 246. The fans 246 are driven to blow cooled air toward the door 261 or the vinyl strips. The air flows over the trays (which have food products or the like thereon), from the back of the trays to the front of the trays and up the front of the housing and back over the dry ice 263. The air continues to recirculate through the housing 224, over the dry ice 263, into the fan housing 237, and back out over the trays of food.

To remove the rack 22 from the cabinet cooler 220, the user opens the door 261 or parts the vinyl strips. Thereafter, the user rolls the rack 22 out of the cabinet cooler 220. The door 261 is then closed or the vinyl strips are allowed to fall back into place. There is no need to modify the rack 22 or to use ramps to remove the rack 22 from the cabinet cooler 220.

A suitable usage of both of the embodiments of the present invention is as follows. The rack 22 which has trays with food products or the like thereon is wheeled into the cabinet cooler 20, 220 of the present invention. The food products or the like are hot, having a temperature of, for example, 170° F., prior to insertion into the cabinet cooler 20, 220 of the present invention. The cabinet cooler 20, 220 is used to reduce the temperature of the food products or the like to a desired temperature of, for example, 40° F. Thereafter, the rack 22 is removed from the cabinet cooler 20, 220 and moved into a conventional walk-in cooler (not shown) for the final reduction in temperature of the food products or the like to a temperature of, for example, 38° F. When the user is ready to process the food products or the like, the rack 22 is removed from the walk-in cooler for final processing of the food products or the like by the user.

After final processing, the rack 22 can be reinserted into the cabinet cooler 20, 220 and the cabinet cooler 20, 220 and the rack 22 can be directly wheeled to the airline carts. The rack 22 and the trays or just the trays can then be removed from the cabinet cooler 20, 220 for transferring the trays to the airline cart.

The cabinet cooler 20, 220 of the present invention can also be used as a thermal box. The empty rack 22 can be placed within the cabinet cooler 20, 220. Trays with food products or the like are then mounted onto the support members 100*a*, 100*b* while the rack 22 is within the cabinet cooler 20, 220. Preferably, for this type of application, vinyl strips are used to close the front of the housing 24, 224 so that the user does not have to constantly open and close the door 61, 261.

The cabinet cooler 20, 220 of the present invention is used to prevent the temperature of the food products or the like from rising during the time the trays are being prepared and can be used to remove heat from the food products or the like in an efficient manner. In addition, the cabinet cooler 20, 220 of the present invention is not intended to freeze the food products or the like. Usage of the cabinet cooler 20, 220 of the present invention as an intermediate step also reduces condensation within the walk-in cooler and reduces the amount of dehydration of the food products or the like.

The cabinet cooler 20, 220 of the present invention does not require a carbon dioxide tank, does not require a nitrogen tank and does not require plumbing which would be associated with these tanks or any other mechanical apparatus using cooling or freezing. In addition, the cabinet cooler 20, 220 of the present invention is portable making the cabinet cooler very convenient to use.

While preferred embodiments of the present invention are shown and described, it is envisioned that those skilled in the art may devise various modifications without departing from the spirit and scope of the foregoing description.

The invention is claimed as follows:

1. A cabinet cooler comprising:

a housing having a lower wall, a pair of opposite side walls, a rear wall, and a top wall, said walls defining a cavity within said housing;

a pair of slots provided in said lower wall;

a pair of seals mounted to each said slot;

means for covering said cavity within said housing;

a plurality of wheels attached to said lower wall of said housing;

an upper slot provided in each said side wall proximate to said top wall;

a lower slot provided in each said side wall below said upper slot;

a partition mounted within said housing, said partition extending vertically upwardly from said lower wall of said housing to a position proximate to said lower slots, said partition further extending between said pair of opposite side walls of said housing and being spaced from said rear wall of said housing, said partition having at least one aperture therethrough, said partition, said rear wall, and said side walls defining an opening proximate to a top end of said partition;

at least one fan mounted between said partition and said rear wall of said housing, said at least one fan being in communication with said opening and said at least one aperture;

a panel being slidably mounted within said lower slots, said panel having a length that is smaller than a length of said side walls, said panel being capable of sliding within said lower slots of said side walls from a position where said panel abuts against said rear wall of said housing and covers said opening, to a position where said panel is spaced from said rear wall of said housing and uncovers said opening; and a dry ice storage for holding dry ice, said dry ice storage being removably mounted within said upper slots and between said panel and said top wall of said housing, said dry ice storage having a wall being at least partially covered by a mesh screen.

2. A cabinet cooler as defined in claim 1, in combination with a rack, said rack including first, second, third and fourth vertical legs, each said vertical leg having a wheel at a lower end thereof, a plurality of horizontal support members connected between said first and second vertical legs, a plurality of horizontal support members connected between said third and fourth vertical legs, a first diagonal member proximate to said wheels for connecting two of vertical legs together, a second diagonal member distal from said wheels for connecting said second and third vertical legs, and a third diagonal member distal from said wheels for connecting said first and fourth vertical legs, said vertical legs of said rack capable of being positioned within said slots of said lower wall of said housing such that said rack can be positioned within said opening of said housing.

3. A cabinet cooler as defined in claim 1, wherein said panel is formed of one of fiberglass and polyethylene with urethane insulation.

4. A cabinet cooler comprising:

a housing having a lower wall, a pair of opposite side walls, a rear wall, and a top wall, said walls defining a cavity within said housing;

means for covering said opening in said housing;

a partition mounted within said housing and spaced from said rear wall, said partition, said rear wall and said side walls defining an opening proximate to a top end of said partition, said partition having at least one aperture therethrough;

at least one fan mounted between said partition and said rear wall of said housing, said at least one fan being in communication with said opening and said at least one.aperture in said partition;

a panel being slidably mounted along said side walls of said housing, said panel being capable of being slid to cover or uncover said opening; and a dry ice storage being mounted between said panel and said top wall of said housing.

5. A cabinet cooler as defined in claim 4, wherein said lower wall of said housing has a pair of slots therethrough.

6. A cabinet cooler as defined in claim 5, in combination with a rack, said rack being capable of being positioned within said slots such that said rack can be positioned within said cavity within said housing.

7. The combination as defined in claim 6, wherein said rack includes first, second, third and fourth vertical legs, each said vertical leg having a wheel at a lower end thereof, a plurality of horizontal support members connected between said first and second vertical legs, a plurality of horizontal support members connected between said third and fourth vertical legs, a first diagonal member proximate to said wheels for connecting two of said vertical legs together, a second diagonal member distal from said wheels for connecting said second and third vertical legs, and a third diagonal member distal from said wheels for connecting said first and fourth vertical legs, said vertical legs of said rack capable of being positioned within said slots of said lower wall of said housing such that said rack can be positioned within said opening of said housing.

8. A cabinet cooler as defined in claim 5, further including a pair of seals connected to said lower wall of said housing in each said slot.

9. A cabinet cooler as defined in claim 4, further including a plurality of wheels attached to said lower wall of said housing.

10. A cabinet cooler as defined in claim 4, wherein said means for covering is a door hingedly connected to one of said side walls.

11. A cabinet cooler as defined in claim 4, wherein said means for covering is a plurality of vinyl straps suspended from said top wall of said housing.

12. A cabinet cooler as defined in claim 4, wherein each said side wall has an upper slot proximate to said top wall of said housing in which said dry ice storage is mounted and a lower slot below said upper slot, said panel being slidably mounted in said lower slot.

13. A cabinet cooler as defined in claim 12, wherein said panel has a length that is smaller than a length of said side walls of said housing, said panel being capable of sliding within said lower slots of said side walls from a position where said panel abuts against said rear wall of said housing and covers said opening to a position where said panel is spaced from said rear wall of said housing and uncovers said opening.

14. A cabinet cooler as defined in claim 13, wherein said dry ice storage is removably mounted within said upper slots between said panel and said top wall of said housing, said dry ice storage having a wall being at least partially covered by a mesh screen.

15. A cabinet cooler as defined in claim 4, wherein said panel is formed of one of fiberglass and polyethylene with urethane insulation.

16. A cabinet cooler comprising:

means for housing a rack;

means for covering said housing means;

means for separating said housing means into a first portion and a second portion;

means for allowing said first portion to communicate with said second portion;

means for storing dry ice;

means for sucking air cooled by said dry ice into said first portion and blowing said cooled air into said second portion; and means for preventing said sucking means from sucking said cooled air into said first portion.

* * * * *